US005242223A

United States Patent [19]

Koves

[11] Patent Number: 5,242,223

[45] Date of Patent: Sep. 7, 1993

[54] DIVIDERS FOR DRAWERS OR THE LIKE

[76] Inventor: Thomas Koves, P.O. Box 1387, Anahuac, Tex. 77514

[21] Appl. No.: 912,763

[22] Filed: Jul. 13, 1992

[51] Int. Cl.[5] ..... A47B 88/20

[52] U.S. Cl. ..... 312/348.3; 211/184; 24/304; 248/908

[58] Field of Search ..... 312/348.3, 193; 211/184; 24/304, DIG. 11; 248/909, 205.3

[56] References Cited

U.S. PATENT DOCUMENTS

| | | | |
|---|---|---|---|
| 3,656,786 | 4/1972 | Larson | 211/184 |
| 3,999,663 | 12/1976 | Walter | 248/909 |
| 4,488,653 | 12/1984 | Belokin | 248/909 |
| 4,595,248 | 6/1986 | Brass | 312/348.3 |
| 4,693,382 | 9/1987 | Galen | 211/184 |

FOREIGN PATENT DOCUMENTS

| | | | |
|---|---|---|---|
| 116013 | 8/1984 | European Pat. Off. | 312/348.3 |
| 1280108 | 11/1960 | France | 211/184 |
| 1160414 | 8/1969 | United Kingdom | 312/348.3 |

*Primary Examiner*—Peter M. Cuomo
*Assistant Examiner*—Flemming Saether
*Attorney, Agent, or Firm*—Allan M. Shapiro

[57] ABSTRACT

Divider panels are sized to fit partway or all the way across a drawer or the like and extend sufficiently high to functionally divide the drawer into separate areas. The divider panels are notched for breakoff to the desired length. The divider panels are held in place by bifurcated mounting supports which can be secured to the drawer bottom, drawer sides or another divider panel to retain the divider panels in the selected position.

7 Claims, 1 Drawing Sheet

FIG. 1
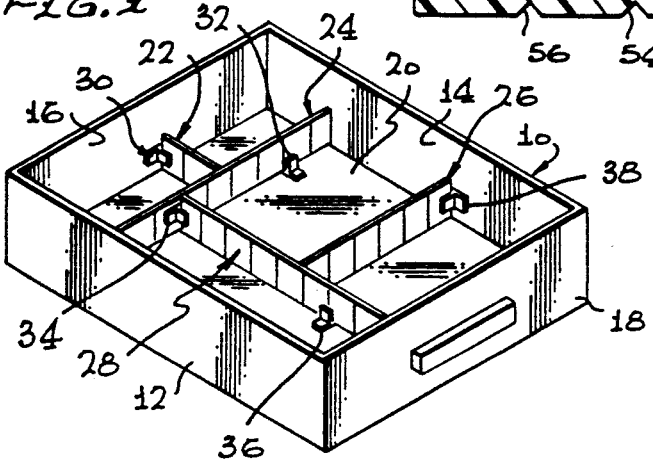
FIG. 4
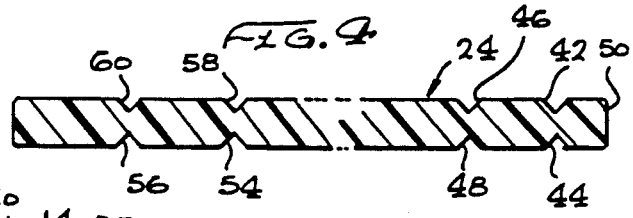
FIG. 2
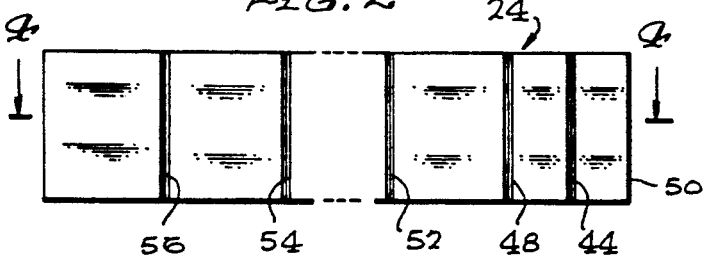
FIG. 3
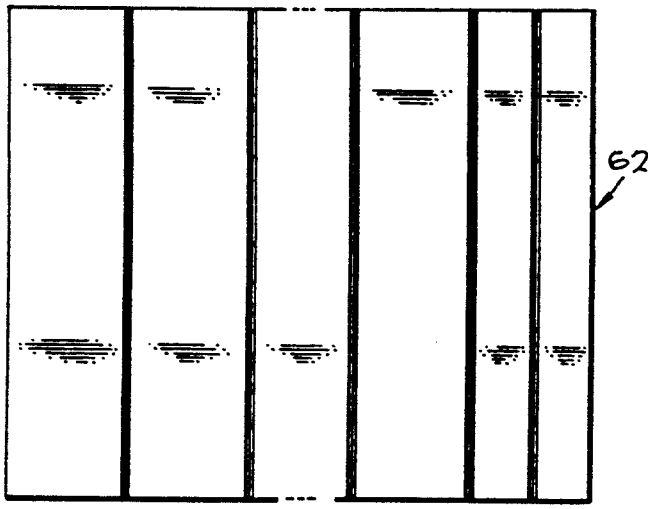
FIG. 5
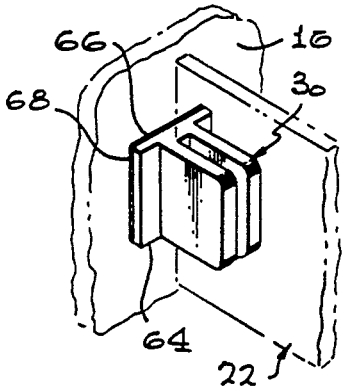
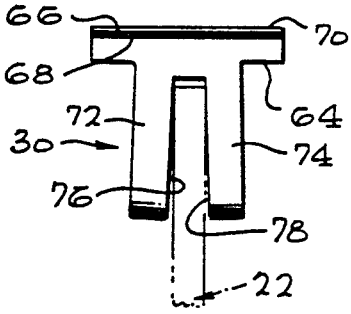
FIG. 6

DIVIDERS FOR DRAWERS OR THE LIKE

FIELD OF THE INVENTION

This invention is directed to a divider for drawers or the like wherein divider panels are positioned in the drawer with the length created by breaking the panels off at snap notches and are held in place with bifurcated mounting supports.

BACKGROUND OF THE INVENTION

It is impossible to organize the contents of a drawer into groups of things without divider panels because the opening and closing of the drawer causes relative motion between the things in the drawer and the drawer itself. To keep these things organized, drawer dividers are necessary.

Some drawers are originally manufactured with fixed drawer dividers. However, systems of this nature cannot be reconfigured for different needs. Other drawers are originally manufactured with movable dividers, such as those which slide into slots on the interior sides of drawer sides. This system is useful for some kinds of reconfiguration, but needs to be built into the original drawer construction. Therefore, in that system, drawers without the original divider slots cannot be configured later to receive the dividers. Aside from drawers, there are other similar structures which require dividers t maintain organization. Accordingly, there is need for a divider system which can be installed in a drawer without modification of the drawer to create dividers of the space therein.

SUMMARY OF THE INVENTION

In order to aid in the understanding of this invention, it can be stated in essentially summary form that it is directed to dividers for drawers or the like wherein the dividers comprises divider panels and mounting supports. The divider panels are rectangular strips which can be fashioned to a length as needed by the drawer. The mounting support is bifurcated to grasp the divider panels at the ends or bottom to hold the divider panels in the selected location.

Accordingly, it is an object and advantage of this invention to provide dividers for drawers or the like wherein divider panels are fashioned to length for the divider configuration desired within the drawer and mounting supports hold the dividers in place by engaging the drawer sides and the divider panel ends and/or beneath the divider panels to engage the lower edge of the divider panels and the drawer bottom.

It is a further object and advantage of this invention to provide dividers for drawers or like wherein the divider panels are fashioned so that they may be broken to length so that they may be configured as desired within the drawer.

It is a further object and advantage of this invention to provide bifurcated mounting supports for the divider panels with the mounting supports configured to grasp the divider panels on their lower edge to support the divider panels with respect to the drawer bottom and configured to grasp the divider panels at the ends to secure the divider panels with respect to the drawer sides and/or other divider panels.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 1 is an isometric view of a drawer or the like containing dividers in accordance with this invention.

FIG. 2 is a side-elevational view of a divider panel, with the center broken away to show it is of greater length and showing the breakoff notches.

FIG. 3 is a view similar to FIG. 2, but showing a divider panel of taller configuration for deeper drawers.

FIG. 4 is an enlarged section taken generally along line 4—4 of FIG. 2, showing the notches in the divider panel.

FIG. 5 is an isometric view of one of the bifurcated mounting supports, shown in mounting position with respect to a drawer side and a divider panel shown in dashed lines.

FIG. 6 is a plan view of a bifurcated mounting support, with a divider panel shown in dashed lines.

DESCRIPTION OF THE PREFERRED EMBODIMENTS

A drawer 10 is shown in FIG. 1. The drawer 10 has left and right sides 12 and 14, back side 16 and front side 18. Bottom 20 is attached to the sides and closes the drawer bottom. This configuration resembles an open-top box, and the dividers of this invention can be used in a box-type structure in addition to being useful in the drawer 10 Dividers 22, 24, 26 and 28 lie adjacent the bottom 20 and stand in an upright position to divide the lower part of the drawer into different compartments. They are held in place by mounting supports 30, 32, 34, 36 and 38, as well other mounting supports not seen in FIG. 1.

All of the dividers are the same, except that they may be shortened in accordance with the divider needs. Divider 24 is shown in detail in FIGS. 2 and 4 and is an example of each of the dividers. As is seen in FIGS. 2 and 4, divider 24 is a substantially rectangular solid. It is made of injection-molded thermoplastic synthetic polymer composition material of fairly hard and strong characteristics. As a particular example, the divider 24 is 1/16 inch thick, 1¼ inch tall, and 6 inches long. The length is divided by notches. Notches 42 and 44 are seen as opposite each other adjacent the right end of divider 24, as seen in FIG. 4. Notches 46 and 48 are shown adjacent each other. In accordance with this particular example, the notches 42 and 44 are ½ inch from the right end 50 of the divider; and notches 48 and 46 are ½ inch from the notches 42 and 44, respectively. There are additional notches spaced at 1 inch intervals down the length of the divider 24. As seen in FIG. 2, notches 52, 54 and 56 are shown. In accordance with the teaching of notches 46 and 48, there are also corresponding notches 58 and 60 in the far side of the divider 24, as seen in FIG. 2. Each of the notches 48 through 56 are spaced 1 inch apart along the length of the divider 24. The notches are sized and the divider is of such strength as to permit the divider to be shortened by breaking it off at one of the notches. Thus, the divider 24 may be shortened from its full 6 inch length to a lesser length in 1 inch and ½ inch increments. Divider 62, shown in FIG. 3, is identical to the dividers 22 through 28, except that it is taller. The divider 62 is useful in drawers which are deeper and for which deep dividers are desired. It is structurally similar and useful in the same way.

The bifurcated mounting support 30 is shown in more detail in FIGS. 5 and 6. The bifurcated mounting support 30 has a base 64 which has a flat mounting surface 66. The mounting surface carries a pressure-sensitive adhesive 68 which is supplied with a protective release sheet 70. When the release sheet 70 is removed, the adhesive 68 is exposed so that the mounting support 30 can be placed in the desired location. In the present instance, the location is against the back side 16. However, as illustrated in FIG. 1, the mounting support can be placed against the side wall as support 38, against the bottom as support 32, or against a divider as support 34. The mounting supports are appropriately secured in place, and the dividers are broken to length and placed between the fingers 72 and 74, which are the bifurcated portion of the mounting support which grasps a divider. The spacing between the fingers is such as to firmly receive the divider so that the divider is grasped and securely held. The length of the fingers from the base end to the free end is ½ inch, which is equal to the smaller breakoff portion of the divider. In this way, the dividers will always be grasped by the fingers. If the divider is slightly less than ½ inch too long and ½ inch is broken off, the shorter divider can now be engaged and grasped between the fingers and extend halfway down between the fingers to the base. This is adequate support for the divider. The base is preferably ½ inch square when the divider is about ½ inch tall for the example shown in FIG. 2. The mounting support is preferably injection-molded of thermoplastic synthetic polymer composition material so as to be inexpensively supplied. An alternate method of manufacture is to extrude the material through an appropriate die and cut it off to the desired length, as indicated in FIG. 5.

Divider 62, except for its height, is the same as divider 24 and can be used in the same way. In view of the height of the divider 62, it may be desirable to use two mounting supports on the sides of the drawer, one above the other, to support the height of the taller divider 62. Other than that difference, the divider 62 is used in the same way and has different sections broken off in order to achieve the desired width.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A divider system comprising:

a container having sides and a bottom, said sides and said bottom being rectangularly arranged to define a substantially rectangular open-top container;

a plurality of mounting supports, each of said plurality of mounting supports having a mounting surface with adhesive thereon and a plurality of said mounting supports being attached to said sides and said bottom of said container, each of said mounting supports having a pair of fingers thereon opposite said mounting surface, said fingers being spaced from each other substantially a thickness dimension;

a plurality of dividers, each of said plurality of dividers being of such substantially rectangular configuration and having a length, a width and a thickness, each of said plurality of dividers having notches in the width-wise direction thereof for breaking off said dividers to a selected length dimension, said dividers being engaged between said fingers on said mounting supports so that said dividers are supported from the sides and bottom of said container.

2. The divider system of claim 1 wherein at least one of said mounting supports is attached to the side of one of said dividers.

3. The divider system of claim 1 wherein said adhesive is pressure-sensitive adhesive.

4. The divider system of claim 1 wherein said fingers have a dimension parallel to said mounting surface and said fingers are substantially equal in length along said dimension as said mounting surface.

5. The divider system of claim 1 wherein both said dividers and said mounting supports are made of thermoplastic synthetic polymer composition material.

6. The divider system of claim 1 wherein the length of said fingers for engaging said dividers therebetween is greater than the length of the smallest breakoff portion of said dividers so that said dividers can be broken off at a selected length and engaged between said fingers.

7. The divider system of claim 5 wherein said fingers have a dimension parallel to said mounting surface and said fingers are substantially equal in length along said dimension as said mounting surface.

* * * * *